US006441698B1

(12) United States Patent
Matsutani et al.

(10) Patent No.: US 6,441,698 B1
(45) Date of Patent: Aug. 27, 2002

(54) DIELECTRIC-WAVEGUIDE ATTENUATOR, DIELECTRIC-WAVEGUIDE TERMINATOR, AND WIRELESS APPARATUS INCORPORATING SAME

(75) Inventors: Kei Matsutani; Hiromu Tokudera, both of Nagaokakyo (JP)

(73) Assignee: Murata Manufacturing Co. Ltd. (JP)

( * ) Notice: Subject to any disclaimer, the term of this patent is extended or adjusted under 35 U.S.C. 154(b) by 0 days.

(21) Appl. No.: 09/604,206

(22) Filed: Jun. 27, 2000

(30) Foreign Application Priority Data

Jun. 28, 1999 (JP) ..... 11-181472

(51) Int. Cl.[7] ..... H01P 1/22; H01P 3/16

(52) U.S. Cl. ..... 333/81 B; 333/248; 333/251; 333/24.2

(58) Field of Search ..... 333/248, 251, 333/81 B, 24.2, 22 R

(56) References Cited

U.S. PATENT DOCUMENTS 5,770,989 A * 6/1998 Ishikawa et al. ..... 333/248
5,781,086 A 7/1998 Kato et al. ..... 333/248
6,094,106 A * 7/2000 Kishino et al. ..... 333/22 R

* cited by examiner

*Primary Examiner*—Robert Pascal
*Assistant Examiner*—Stephen E. Jones
(74) *Attorney, Agent, or Firm*—Ostrolenk, Faber, Gerb & Soffen, LLP

(57) ABSTRACT

A dielectric-waveguide attenuator, a dielectric-waveguide terminator, and a wireless apparatus incorporating the same in which the length of a dielectric waveguide is shortened in a direction in which an electromagnetic wave propagates to reduce the size of the overall module. The two parts of a split dielectric strip are placed between an upper conductive plate and a lower conductive plate to form the dielectric waveguide, and a substrate having at least two resistance-film patterns formed thereon is positioned between the two dielectric strips. With this arrangement, the resistance films both attenuate signals and also discontinuously change line impedance at a plurality of places and synthesize the electromagnetic waves reflected at the parts where the line impedance discontinuously changes so that the reflected waves cancel each other.

15 Claims, 6 Drawing Sheets

DIELECTRIC-WAVEGUIDE ATTENUATOR, DIELECTRIC-WAVEGUIDE TERMINATOR, AND WIRELESS APPARATUS INCORPORATING SAME

BACKGROUND OF THE INVENTION

1. Field of the Invention

The present invention relates to dielectric-waveguide attenuators, dielectric-waveguide terminators, which are used in millimeter-wave bands, and wireless apparatuses incorporating the same.

2. Description of the Related Art

A millimeter-wave integrated circuit incorporating a non-radiative dielectric waveguide, which is hereinafter referred to as an "NRD waveguide" is described in the Journal of the Institute of Electronics, Information and Wireless Engineers, C-1, Vol. J73-C-I, No. 3, p.87–94 (Mar. 1990.).

In the NRD waveguide, a dielectric strip is disposed between two parallel planar conductors to form an area through which an electromagnetic wave propagates. A space between the two planar conductors on each side of the dielectric strip is structured so that in that area, the electromagnetic wave is blocked. In order to form a terminator in the NRD waveguide, as shown in the Journal cited above, a resistance film for absorbing the electromagnetic wave is disposed on the dielectric strip.

FIG. 7 is a perspective view illustrating the structure of the terminator. In this figure, upper and lower planar conductors are omitted. A dielectric strip shown in the figure is placed between the upper and lower planar conductors to form an area in which an electromagnetic wave propagates. Between upper and lower parts of the dielectric strip, obtained by splitting the dielectric strip in half, a resistance sheet and a dielectric sheet are placed. As shown in FIG. 7, parts of the resistance sheet and the dielectric sheet are tapered to perform impedance conversion of the dielectric-waveguide at the tapered sections. In addition, the resistance sheet consumes $LSM_{01}$-mode energy propagating through the dielectric waveguide and thereby absorbs the electromagnetic wave. As a result, the electromagnetic wave propagating from a direction A in the figure is terminated at the location where the terminator is formed, and the electromagnetic wave is hardly reflected in the direction opposite to the direction A.

In the conventional dielectric-waveguide terminator as shown in FIG. 7, in which the tapered resistance sheet is used to perform impedance conversion, it is necessary for the tapered part to be long enough to obtain sufficiently low reflection characteristics. As a result, this creates a problem in that the overall length of the terminator is increased.

Such a dielectric-waveguide terminator, for example, may be disposed at a specified port of a circulator to form an isolator, or the terminator may be disposed at a specified port of a coupler to form a directional coupler. As mentioned above, since the overall length of the terminator is increased, in the case of a dielectric-waveguide module incorporating the isolator and the directional coupler, the overall size of the module is also increased. In this case, it may be possible to locate the terminator at a specified position so as to reduce the size of the module, but it may be difficult to do so.

In addition, forming a bend in the dielectric waveguide is also effective to reduce the size of the module. However, in this case, there is a problem in that loss is increased by mode conversion between an LSM mode and an LSE mode occurring at the bend.

In addition, a dielectric-waveguide attenuator can be formed by disposing a resistance film in the dielectric strip between the ends of the dielectric waveguide. However, in order to sufficiently suppress reflection by the resistance film, a long-tapered resistance-film pattern must be used, as in the case of the above-mentioned dielectric-waveguide terminator. As a result, the dielectric-waveguide attenuator has the same problems that occur in the dielectric-waveguide terminator.

SUMMARY OF THE INVENTION

Accordingly, it is an object of the present invention to provide a dielectric-waveguide attenuator, a dielectric-waveguide terminator, and a wireless apparatus incorporating the same, in which the dielectric waveguide has a short length in a direction in which an electromagnetic wave propagates, to reduce the overall size of the module.

To this end, according to one aspect of the present invention, there is provided a dielectric-waveguide attenuator including two substantially parallel planar conductors, a dielectric strip placed therebetween so that a dielectric waveguide is formed, a reflected-wave suppressing unit for changing line impedance of the dielectric waveguide at a plurality of discontinuous points and suppressing the reflected waves of signals occurring at the plurality of discontinuous points, wherein resistance films form at least a part of the reflected-wave suppressing unit. The resistance films are disposed on a surface defined halfway through the dielectric strip and substantially in parallel to the planar conductors, and attenuate signals propagating through the dielectric waveguide.

In the above structure, the resistance films attenuate the signals propagating through the dielectric waveguide. Furthermore, the reflected-wave suppressing unit suppresses the reflections occurring at the plurality of discontinuous parts formed by the resistance films.

In this dielectric-waveguide attenuator, the resistance films may have different widths in a direction perpendicular to the dielectric strip. Even if the resistance films are connected together, the parts thereof having different widths in the perpendicular direction may be equivalent to the above-mentioned plurality of discontinuous parts.

In addition, in the above dielectric-waveguide attenuator, the resistance films may form patterns disposed intermittently in a direction in which the dielectric strip extends. The parts where the intermittent patterns are formed may be equivalent to the plurality of discontinuous parts.

As described above, since the discontinuous line-impedance changing parts are formed by the patterns of the resistance films, attenuation of the signal propagating through the dielectric waveguide and suppression of the reflected waves are simultaneously performed.

Furthermore, in the above dielectric-waveguide attenuator, the distance between the discontinuous line-impedance changing parts may be set to be an odd multiple of substantially one fourth the wavelength of a reflected wave to be suppressed. With this arrangement, the reflected wave to be suppressed can be efficiently cancelled and satisfactorily low reflection characteristics can thereby be obtained.

Furthermore, in the above dielectric-waveguide attenuator, the discontinuous parts may be formed at three or more places, and a plurality of reflected waves having different wavelengths may be suppressed by reflected waves occurring at respective ones of the discontinuous parts. With this arrangement, the reflected waves can be suppressed over a relatively wide range.

Furthermore, in the above dielectric-waveguide attenuator, the permittivity of a substrate having the resistance-film patterns formed thereon may be higher than the permittivity of the dielectric strip. With this arrangement, a wavelength shortening effect in the substrate is increased, and further, areas occupied by the resistance-film patterns are relatively reduced so that the size of the whole structure is reduced.

According to another aspect of the present invention, there is provided a dielectric-waveguide terminator including the above dielectric-waveguide attenuator disposed near the end portion of the dielectric strip.

According to another aspect of the present invention, there is provided a wireless apparatus including one of the above dielectric-waveguide attenuator and the above dielectric-waveguide terminator. For example, the dielectric-waveguide terminator can form part of an isolator and a coupler for transmitting a millimeter-wave transmission/reception signal in a millimeter-wave radar module.

Other aspects, features and advantages of the present invention will become apparent from the following description of embodiments of the invention which refers to the accompanying drawings.

DESCRIPTION OF EMBODIMENTS OF THE INVENTION

Figure 1:
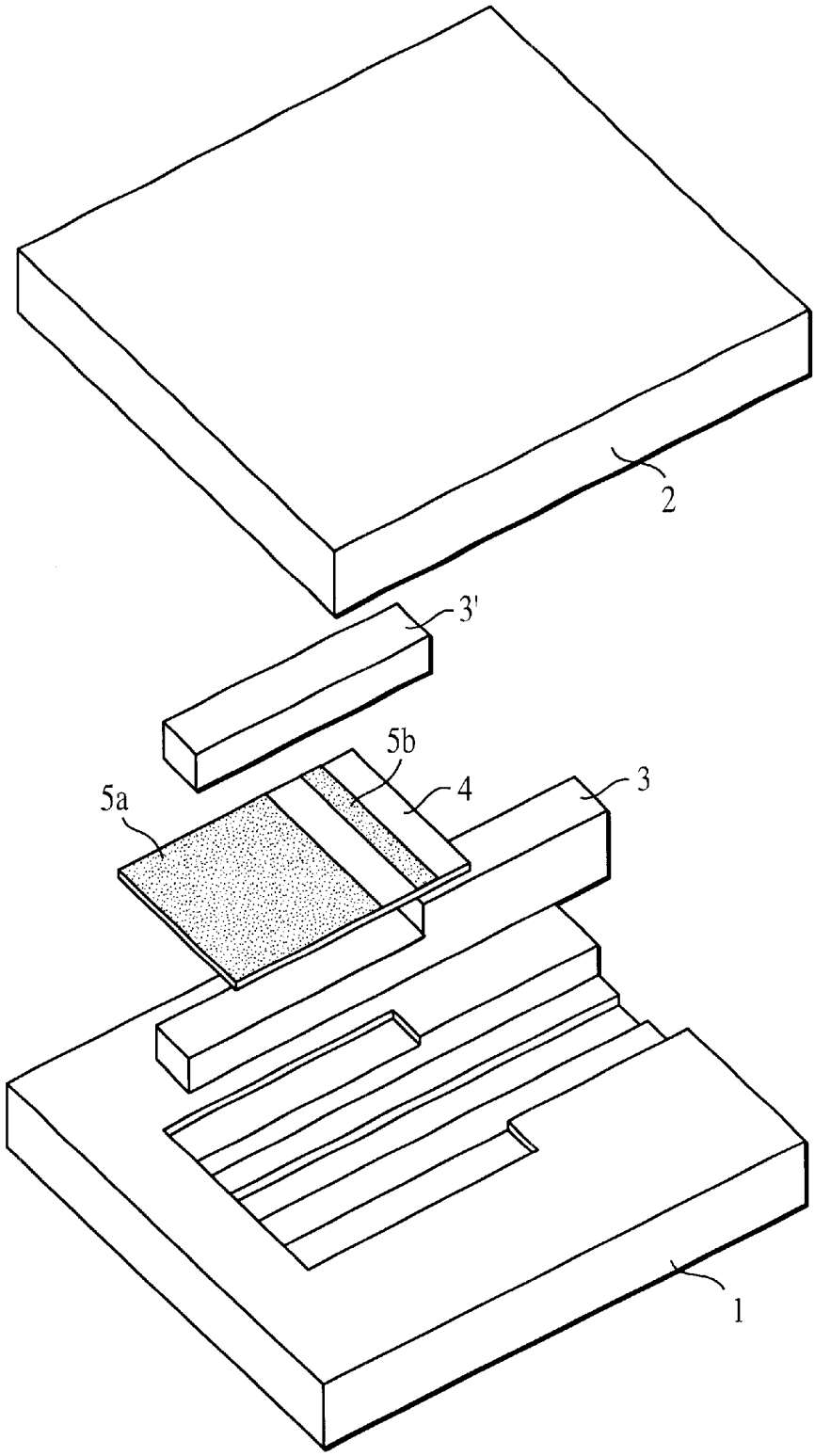
FIG. 1 is an exploded perspective view illustrating the structure of a dielectric-waveguide terminator according to a first embodiment of the present invention.
Figure 2A:
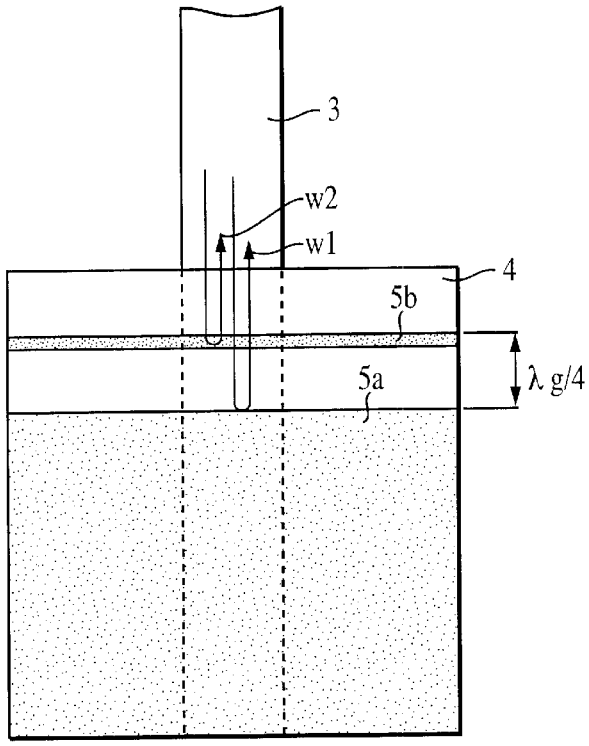
FIG. 2A is a plan view of the main part of the dielectric-waveguide terminator and FIG. 2B shows a sectional view thereof.
Figure 2B:
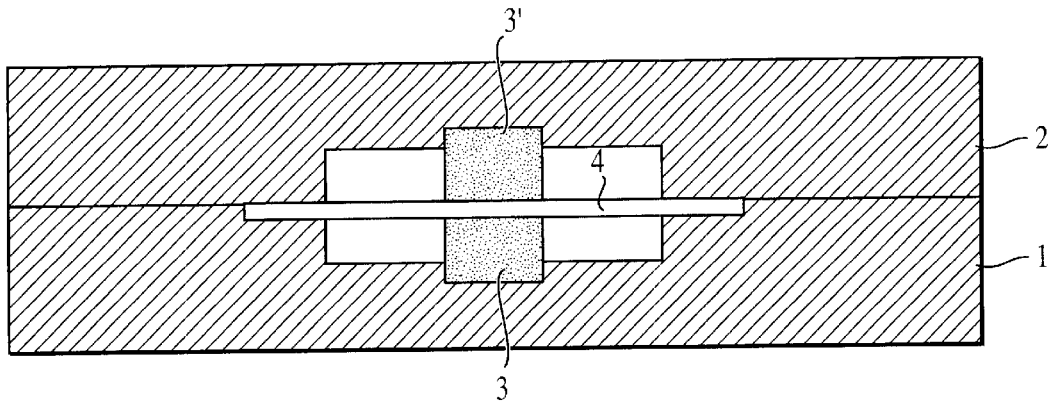
Figure 3:
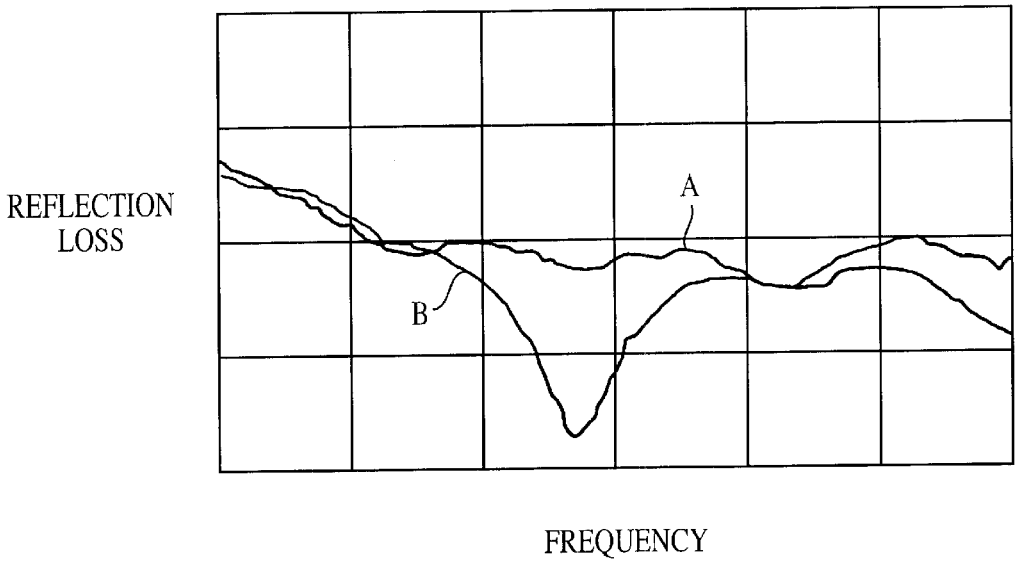
FIG. 3 is a graph of reflection loss versus frequency in the dielectric-waveguide terminator.

Referring to FIGS. 1 to 3, a description will be given of the structure of a dielectric-waveguide terminator according to a first embodiment of the present invention.

FIG. 1 is an exploded perspective view of the main part of the dielectric-waveguide terminator. In this figure, reference numerals 1 and 2 denote conductive plates, and reference numerals 3 and 3' denote dielectric strips placed between the upper and lower conductive plates 1 and 2. Reference numeral 4 denotes a substrate, on which resistance-film patterns 5*a* and 5*b* are formed. The substrate 4 is also placed between the conductive plates 1 and 2.

As shown in FIG. 1, the dielectric strip 3 has a stepped part to retain the substrate 4 between the upper dielectric strip 3' and the stepped part of the lower dielectric strip 3.

In FIG. 1, the dielectric strips 3 and 3' may be made of fluoropolymers having good high-frequency characteristics. The substrate 4 may be formed by a sheet made of polyester resin having a thickness range of approximately 0.1 to 0.3 mm. The resistance-film patterns 5*a* and 5*b* may be formed by thin films of a metal having a relatively low resistivity such as Ni—Cr or a semiconductor such as ITO (indium tin oxide), the thin films being produced by sputtering, for example. The surface-resistance value of the resistance film used here is approximately a few hundred ohms.

FIG. 2A shows a top view of the substrate 4 shown in FIG. 1, and FIG. 2B shows a sectional view taken along a surface perpendicular to the longitudinal direction of the dielectric strip in the assembly of the parts shown in FIG. 1.

Grooves having fixed depths are formed in the conductive plates 1 and 2 to receive the dielectric strips 3 and 3'. In addition, a recess is formed in the lower conductive plate 1 to receive the substrate 4. The recess is used to retain the substrate 4 between the conductive plates 1 and 2 and between the dielectric strips 3 and 3'.

As shown in FIG. 2A, the resistance-film pattern 5*a* on the substrate 4 extends a specified distance in the longitudinal direction of the dielectric strip 3. The resistance-film pattern 5*b* is relatively narrow in the longitudinal direction of the dielectric strip 3, and extends in a direction perpendicular to the dielectric strip 3 in a position at a specified distance from the resistance-film pattern 5*a*. The resistance-film patterns 5*a* and 5*b* form a reflected-wave suppressing unit.

As described above, when the substrate 4 having the resistance-film patterns 5*a* and 5*b* formed thereon is placed between the dielectric strips 3 and 3', the line impedance of the dielectric waveguide changes, between a part where the resistance-film pattern exists, and a part where no resistance-film pattern exists. As a result, as shown in FIG. 2A, an electromagnetic wave propagating through the dielectric waveguide is reflected at a boundary of each of the resistance-film patterns 5*a* and 5*b*. The reflected waves denoted by reference characters w1 and w2 are mutually synthesized. If the wavelength of the reflected waves to be suppressed on the dielectric waveguide is indicated by $\lambda g$, the distance between the resistance-film patterns 5*a* and 5*b* is set to be substantially $\lambda g/4$. With this arrangement, the wave w1 reflected at an edge of the resistance-film pattern 5*a* and the wave w2 reflected at an edge of the resistance-film pattern 5*b* are synthesized in substantially opposite phases to each other so as to be cancelled. Furthermore, since the resistance-film pattern 5*b* has a certain width in the longitudinal direction of the strip, reflected waves having wavelengths close to $\lambda g$ can be effectively suppressed.

Meanwhile, regarding the resistance-film pattern 5*a*, an $LSM_{01}$-mode electromagnetic wave propagating through the dielectric waveguide is dissipated in the resistance film. That is, the electromagnetic wave is absorbed therein.

Figure 7:
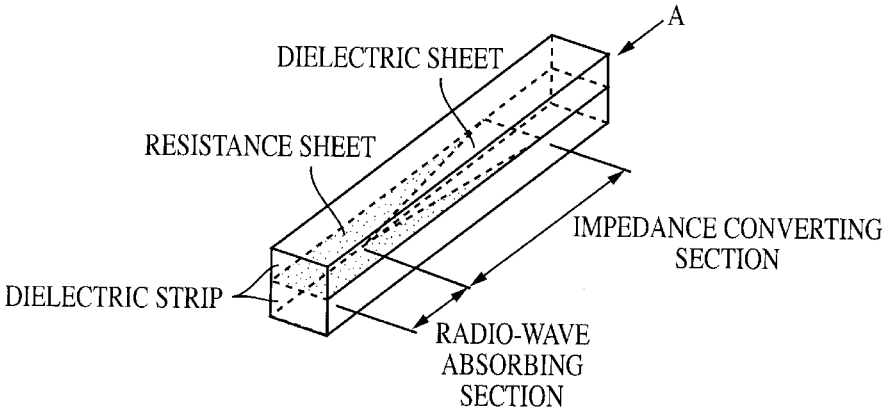
FIG. 7 PRIOR ART
FIG. 7 is a perspective view illustrating the structure of a conventional dielectric-waveguide terminator.

FIG. 3 is a graph showing the reflection characteristics of the dielectric-waveguide terminator of the first embodiment, compared with those of a conventional dielectric-waveguide terminator. In this case, the symbol A indicates reflection loss versus frequency in a dielectric-waveguide terminator in which a conventional impedance converting section is formed by a tapered resistance-film pattern as shown in FIG. 7. The symbol B indicates reflection loss versus frequency in a dielectric-waveguide terminator in which the above-described discontinuous line-impedance changing parts form impedance converting sections.

As evident in the graph, in a specified frequency band, the arrangement of the present invention can provide reflection characteristics lower than those obtained with a tapered resistance film. In addition, as shown in FIG. 2A, the frequency having lower reflection loss is generated according to the distance between the two resistance-film patterns. Thus, by determining the distance, satisfactory reflection characteristics can be obtained in an arbitrary frequency band.

In the example shown above, since a material having higher permittivity than that of the dielectric strip is used as the basic material of the substrate 4, the physical lengths of the resistance-film patterns 5*a* and 5*b* shown in FIG. 2 can be shortened, with the result that the size of the dielectric-waveguide terminator can be reduced.

Since the width of each of the resistance-film patterns 5*a* and 5*b* is larger than that of the dielectric strip, their influence on electrical characteristics such as reflection loss can be reduced even if the resistance-film patterns are not precisely positioned on the substrate 4, and the substrate 4 is not precisely positioned between the upper and lower conductive plates.

In addition, as a method for retaining the substrate 4, instead of putting the substrate 4 between the upper and lower conductive plates 1 and 2, the substrate 4 may be attached to the dielectric strips 3 and 3' or may be attached to one or both of the upper and lower conductive plates 1 and 2.

In addition, the basic material of the substrate 4 may be the same as the material of the dielectric strip 3. This case is equivalent to another alternative arrangement in which a resistance film is directly formed on one or both of the upper and lower parts of the dielectric strip.

In the example shown in FIG. 1, the upper and lower conductive plates 1 and 2 contact each other at the end portion of the terminator, which thereby provides a short-circuited end of the dielectric waveguide. However, if the resistance-film pattern 5*a* is long enough to absorb an electromagnetic wave, the end portion of the dielectric waveguide may also be an open-circuited end.

In the first embodiment, the reflected-wave suppressing unit is formed exclusively by resistance-film patterns. However, alternatively, in FIG. 1 and FIGS. 2A and 2B, a conductive film may form the resistance-film pattern 5*b*. This conductive film will form a discontinuous line-impedance changing part for suppressing a wave reflected by the resistance-film pattern 5*a*.

Next, a description will be given of other examples of resistance-film patterns as a second embodiment of the present invention with reference to FIGS. 4A to 4E.

FIGS. 4A to 4E show plan views of substrates having resistance-film patterns thereon after removing the upper and lower conductive plates and the upper dielectric strip 3'.

Figure 4A:
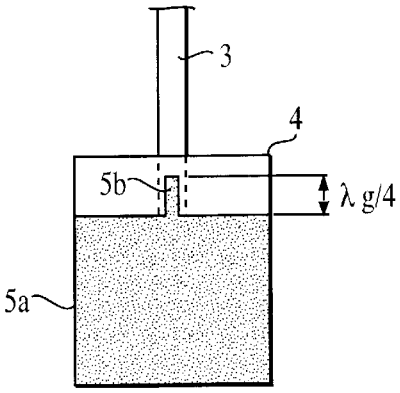
FIGS. 4A to 4E are plan views showing modifications of the main part of a dielectric-waveguide terminator according to a second embodiment of the present invention.

In the example of FIG. 4A, a resistance-film pattern 5*a* extends both in the longitudinal direction of a dielectric strip 3 and in a direction perpendicular to the dielectric strip 3. A resistance-film pattern 5*b* extends in the longitudinal direction of the dielectric strip 3 and is narrow in a direction perpendicular to the dielectric strip. The width of the resistance-film pattern 5*b* is different from that of the resistance-film pattern 5*a* in the direction perpendicular to the dielectric strip. In this arrangement, the parts where the widths of the resistance-film patterns in the direction perpendicular to the dielectric strip are different are equivalent to discontinuous line-impedance changing parts. The distance between the discontinuous line-impedance changing parts is set to be $\lambda g/4$. With this structure, waves reflected at the two parts are synthesized in opposite phase to each other and are thereby suppressed. Further, in the resistance-film pattern 5*a*, an $LSM_{01}$-mode electromagnetic wave propagating through the dielectric waveguide is dissipated. Thus, the electromagnetic wave is absorbed in the resistance film.

Figure 4B:
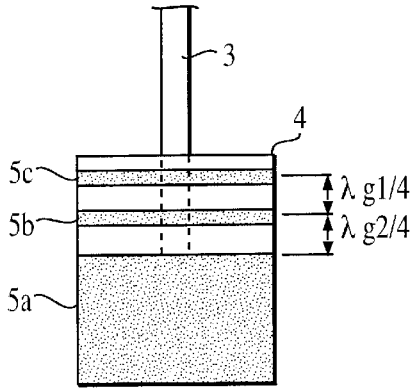

In an example shown in FIG. 4B, in addition to resistance-film patterns 5*a* and 5*b*, another resistance-film pattern 5*c* is formed. In this case, the distance between an edge of the resistance-film pattern 5*a* and the center of the resistance-film pattern 5*b* is set to be substantially $\lambda g_2/4$, and the distance between the center of the resistance-film pattern 5*b* and the center of the resistance-film pattern 5*c* is set to be substantially $\lambda g_1/4$. The symbols $\lambda g_1$ and $\lambda g_2$ represent two different wavelengths of reflected waves to be suppressed. With this arrangement, effective reflected-wave suppression can be formed for both of the two different wavelengths $\lambda g_1$ and $\lambda g_2$. Furthermore, since the resistance-film patterns 5*b* and 5*c* have a width in the direction in which an electromagnetic wave propagating through the dielectric waveguide proceeds, a range of frequency bands in which reflection loss is suppressed is also widened.

Figure 4C:
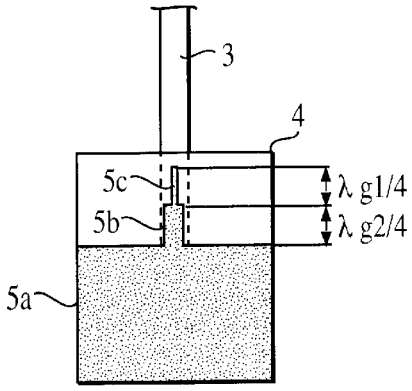

In an example shown in FIG. 4C, in addition to the structure shown in FIG. 4A, there is another resistance-film pattern 5C whose width is different from the widths of the other resistance-film patterns 5*a* and 5*b*, respectively, in a direction perpendicular to the dielectric strip 3. In this case, the length of the resistance-film pattern 5*b* in an electromagnetic-wave propagating direction is set to be substantially $\lambda g_2/4$, and the length of the resistance-film pattern 5*c* in an electromagnetic-wave propagating direction is set to be substantially $\lambda g_1/4$. With this arrangement, reflected waves can be effectively suppressed in proximity to the two wavelengths $\lambda g_1$ and $\lambda g_2$.

Figure 4D:
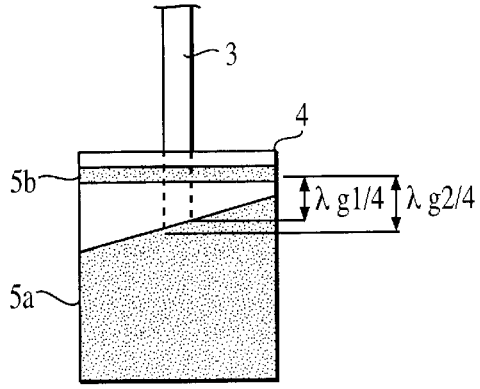

In an example shown in FIG. 4D, there are formed a resistance-film pattern 5*b* extending perpendicularly to the longitudinal direction of the dielectric strip 3 and a resistance-film pattern 5*a* having an edge inclined to the longitudinal direction of the dielectric strip 3. In this case, the distance between the edge of the resistance-film pattern 5*a* and the center of the resistance-film pattern 5*b* is set to be substantially in a range of $\lambda_1/4$ to $\lambda g_2/4$. The symbols $\lambda g_1$ and $\lambda g_2$ represent two different wavelengths of reflected waves to be suppressed. Furthermore, since the resistance-film pattern 5*b* has a width in the direction in which an electromagnetic wave propagating through the dielectric waveguide proceeds, a range of frequency bands in which reflection loss is suppressed is also widened. As a result, continuously low reflection-loss characteristics can be obtained over a specified range of frequency bands.

Figure 4E:
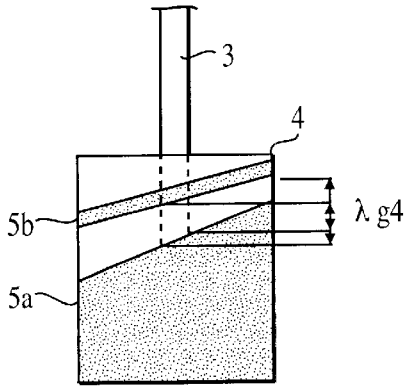

In an example shown in FIG. 4E, one edge of a resistance-film pattern 5*a* is inclined to the longitudinal direction of a dielectric strip 3, and a resistance-film pattern 5*b* extends in a direction inclined to the longitudinal direction of the dielectric strip 3. As a result, continuously low reflection-loss characteristics can be obtained over a specified range of frequency bands.

Next, a description will be given of two structures of a dielectric-waveguide attenuator according to a third embodiment of the present invention with reference to FIGS. 5A and 5B.

Figure 5A:
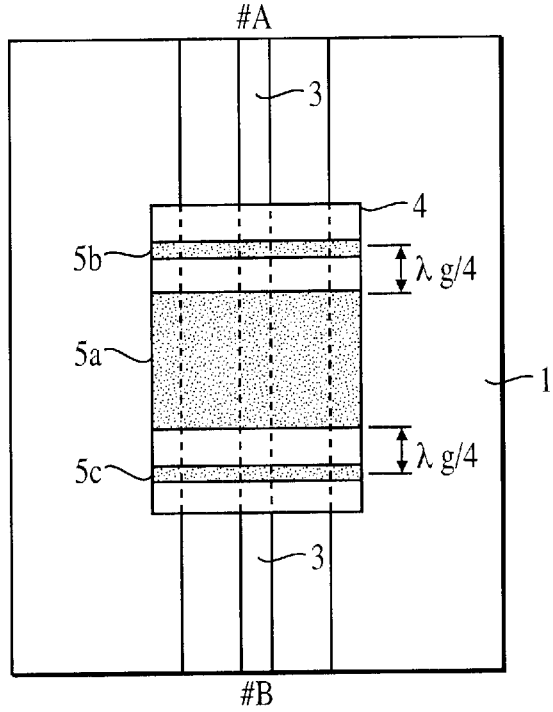
FIGS. 5A and 5B are plan views showing two forms of the main part of a dielectric-waveguide attenuator according to a third embodiment of the present invention.
Figure 5B:
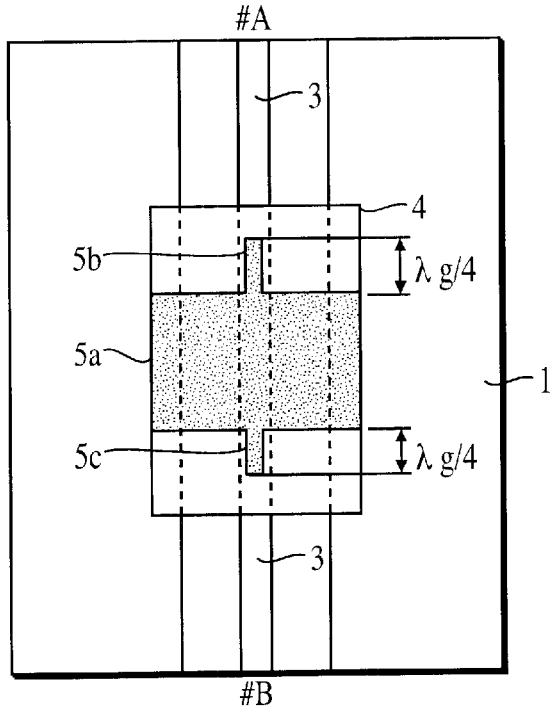

FIGS. 5A and 5B show plan views of the structures in a state in which the upper conductive plate 2 and the upper dielectric strip 3' are removed.

In FIG. 5A, on the upper surface of a substrate 4 are formed resistance-film patterns 5*a*, 5*b*, and 5*c*. In this case, the resistance-film pattern 5*a* extends both in the longitudinal direction of a dielectric strip 3 and in a direction perpendicular to the dielectric strip 3, and couples with an $LSM_{01}$-mode electromagnetic wave propagating through the dielectric waveguide to attenuate the wave. The distance between the resistance-film patterns 5*a* and 5*b* and the distance between the resistance-film patterns 5*a* and 5*c*, respectively, are set to be substantially λg/4. With this arrangement, a wave reflected at one edge of the resistance-film pattern 5*a* and a wave reflected at the resistance-film pattern 5*b* cancel each other. In addition, similar to this, a wave reflected at the other edge of the resistance-film pattern 5*a* and a wave reflected at the resistance-film pattern 5*c* cancel each other. As a result, when an electromagnetic wave propagates from a port #A to a port #B, or vice versa, a wave reflected toward the opposite direction is suppressed and only a specified amount of attenuation in the electromagnetic wave is performed.

In the example shown in FIG. 5B, on the upper surface of a substrate 4 are formed resistance-film patterns 5*a*, 5*b*, and 5*c*. In this case, the resistance-film pattern 5*a* extends both in the longitudinal direction of a dielectric strip 3 and in a direction perpendicular to the dielectric strip 3. The resistance-film pattern 5*a* couples with an $LSM_{01}$-mode electromagnetic wave propagating through the dielectric waveguide to attenuate the wave. The widths of the resistance-film patterns 5*b* and 5*c* in the direction perpendicular to the dielectric strip 3 are made different from the width of the resistance-film pattern 5*a*. The resistance-film patterns 5*b* and 5*c* are patterns extending only a distance of substantially λg/4 in the direction of the dielectric strip 3. With this arrangement, a wave reflected at one edge of the resistance-film pattern 5*a* and a wave reflected at the resistance-film pattern 5*b* cancel each other. In addition, similar to this, a wave reflected at the other edge of the resistance-film pattern 5*a* and a wave reflected at the edge of the resistance-film pattern 5*c* cancel each other. As a result, when an electromagnetic wave propagates from a port #A to a port #B, or vice versa, a wave reflected toward the opposite direction is suppressed and only a specified amount of attenuation in the electromagnetic wave is performed.

Although the first and second embodiments have described examples of dielectric-waveguide terminators, those teachings are also applicable to attenuators. For example, a substrate 4 having a resistance-film pattern 5 formed thereon, as described in connection with the first and second embodiments, can be placed at a specified point (between an input port and an output port) on a dielectric waveguide. Thus, a specified amount of attenuation in an electromagnetic wave propagating through the dielectric waveguide is performed between the input port and the output port so as to form a dielectric-waveguide attenuator. With this arrangement, in the dielectric-waveguide attenuator, similar to the cases shown in FIGS. 4B and 4C, by disposing a discontinuous line-impedance changing part at a plurality of places, a frequency range in which low reflection-loss characteristics can be obtained can be widened. Furthermore, as shown in FIGS. 4D and 4E, by inclining the edge of the resistance-film pattern 5*a* to the longitudinal direction of the dielectric strip 3, the frequency range in which low reflection-loss characteristics can be obtained can also be widened.

Next, a description will be given of the structure of a wireless apparatus according to a fourth embodiment of the present invention with reference to FIG. 6.

Figure 6:
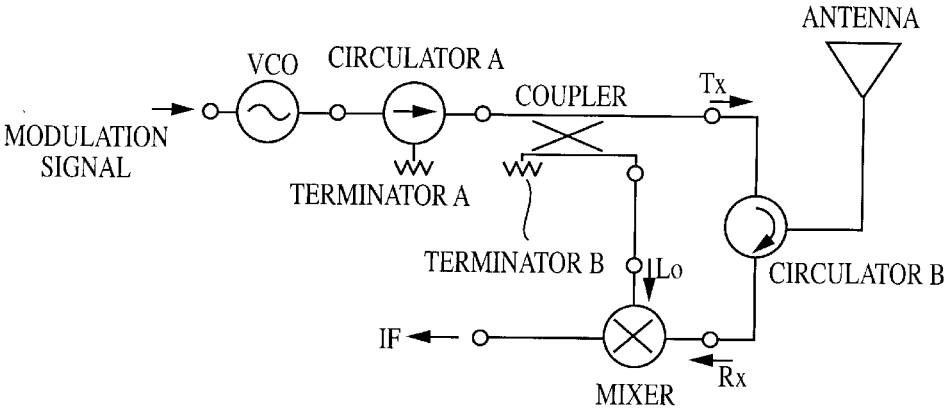
FIG. 6 is a block diagram of a millimeter-wave radar module according to a fourth embodiment of the present invention.

FIG. 6 is a block diagram of a millimeter-wave radar module. In this figure, reference character VCO denotes a voltage-controlled oscillator comprised of a Gunn diode oscillator and a variable reactance element such as a varactor diode. The voltage-controlled oscillator VCO generates millimeter-wave signals according to an input modulation signal. A circulator A and a terminator A transmit an output signal of the VCO to a coupler, and the terminator A absorbs a reflected wave returned toward the VCO. The circulator A and the terminator A form an isolator. The coupler permits the signal transmitted from the circulator A to be propagated as a transmission signal Tx in the direction of a circulator B, and takes out a part of the signal transmitted from the circulator A as a local signal Lo. A terminator B absorbs a reflected wave returned in the direction of the coupler from the circulator B. The coupler and the terminator B form a directional coupler. The circulator B permits the transmission signal Tx to be propagated to an antenna and permits a reception signal Rx from the antenna to be propagated to a mixer. The mixer performs mixing of the reception signal RX and the above local signal Lo to output a beat signal produced from the mixing as an intermediate-frequency signal IF.

As the terminators A and B shown in FIG. 6, the dielectric-waveguide terminator shown in one of the first and second embodiments can be used.

In each of the above embodiments, the terminator comprises a type of dielectric waveguide in which grooves are formed in the upper and lower conductive plates, respectively, for receiving the dielectric strips. However, the terminator can be used in other dielectric waveguides as well, for example one in which the distance between planar conductors is made equal both in a wave-propagating region and a non-wave-propagating region.

Furthermore, in each of the above-described embodiments, the lower dielectric strip has a step formed therein. The substrate is positioned at the stepped part and is positioned below the upper dielectric strip which is shaped so as to compensate for the stepped part. However, there may be an alternative structure in which the entire dielectric strip is split in half along its entire length to form the upper and lower parts, and a substrate having resistance-film patterns formed thereon is disposed between the upper and lower dielectric strips.

In the above embodiments, although the reflected-wave suppressing units are formed by resistance-film patterns, or by both resistance-film patterns and conductive film patterns, in order to suppress waves reflected at the discontinuous line-impedance changing parts formed by the resistance films attenuating a signal propagating through the dielectric waveguide, the discontinuous parts may be formed without using the resistance film patterns or the conductive films on the substrate. For example, alternatively, the sectional configuration of a dielectric strip may be changed at places, the permittivity of the dielectric strip may be changed, or there may be formed a space in the longitudinal direction of the dielectric strip, in order to form line-impedance changing parts. In addition, by making the relative permittivity of the substrate having the resistance films formed thereon different from the relative permittivity of the dielectric strip, an edge of the substrate may be used as a part of a line-impedance changing part of the dielectric waveguide.

As described above, according to one aspect of the present invention, since waves reflected at the line-impedance changing parts formed by the resistance films attenuating the signal propagating through the dielectric waveguide are suppressed by the reflected-wave suppressing unit, the signals can be attenuated with low reflection in a short distance in the signal-propagating direction of the dielectric waveguide.

In addition, since attenuation of the signals propagating through the dielectric waveguide and suppression of the reflected waves can be simultaneously performed by the resistance-film patterns, the overall structure of the dielectric-waveguide attenuator can be simplified, with the result that production of the module is facilitated.

In addition, since the reflected waves to be suppressed can be efficiently canceled, satisfactorily low reflection characteristics with respect to a specified wavelength can be obtained.

In addition, suppression of the reflected waves can be performed over a relatively wide range of frequency bands.

In addition, a wavelength-shortening effect of the substrate is increased and the areas occupied by the resistance-film patterns can be relatively reduced. Thus, the size of the overall dielectric-waveguide attenuator can be reduced.

Furthermore, according to another aspect of the invention, by shortening the length in the signal-propagating direction, an overall compact dielectric-waveguide terminator can be produced.

Furthermore, according to another aspect of the present invention, the size of the wireless apparatus such as a millimeter-wave radar module in which the dielectric waveguide is used as a transmission line can be easily reduced.

While embodiments of the present invention have been described above, it is to be understood that various modifications will be apparent to those skilled in the art without departing from the spirit of the invention.

What is claimed is:

1. A dielectric-waveguide attenuator comprising:

two substantially parallel planar conductors;

a dielectric strip disposed therebetween so as to form a dielectric waveguide for carrying a signal;

a reflected-wave suppressing structure which changes line impedance of the dielectric waveguide at a plurality of discontinuous parts such that at least two reflected waves are generated from said signal at the plurality of discontinuous parts, said reflected waves having a phase offset such that the reflected waves are suppressed; and resistance films forming at least a part of the reflected-wave suppressing structure, the resistance films being disposed on a surface defined within the dielectric strip and substantially in parallel to the planar conductors to attenuate signals propagating through the dielectric waveguide.

2. A dielectric-waveguide attenuator according to claim 1, wherein the resistance films have different widths in a direction perpendicular to the dielectric strip, the parts having said different widths defining said plurality of discontinuous parts.

3. A dielectric-waveguide attenuator according to claim 1, wherein said attenuator is disposed near the end portion of the dielectric strip so as to provide a dielectric-waveguide terminator.

4. A wireless apparatus comprising a high-frequency circuit, and connected thereto, and the dielectric-waveguide terminator according to claim 3.

5. A wireless apparatus according to claim 4, wherein said dielectric-waveguide terminator is comprised in an isolator.

6. A wireless apparatus according to claim 4, wherein said dielectric-waveguide terminator is comprised in a directional coupler.

7. A wireless apparatus comprising a high-frequency circuit, and connected thereto, the dielectric-waveguide attenuator according to claim 1.

8. A dielectric-waveguide attenuator comprising:

two substantially parallel planar conductors;

a dielectric strip disposed therebetween so that a dielectric waveguide is formed;

a reflected-wave suppressing structure for changing line impedance of the dielectric waveguide at a plurality of discontinuous parts and suppressing the reflected waves occurring at the plurality of discontinuous parts; and resistance films forming at least a part of the reflected-wave suppressing structure, the resistance films being disposed on a surface defined within the dielectric strip and substantially in parallel to the planar conductors to attenuate signals propagating through the dielectric waveguide;

wherein the resistance films are intermittently disposed in a direction in which the dielectric strip extends, and the intermittent resistance films define the plurality of discontinuous parts.

9. A dielectric-waveguide attenuator comprising:

two substantially parallel planar conductors;

a dielectric strip disposed therebetween so that a dielectric waveguide is formed;

a reflected-wave suppressing structure for changing line impedance of the dielectric waveguide at a plurality of discontinuous parts and suppressing the reflected waves occurring at the plurality of discontinuous parts; and resistance films forming at least a part of the reflected-wave suppressing structure, the resistance films being disposed on a surface defined within the dielectric strip and substantially in parallel to the planar conductors to attenuate signals propagating through the dielectric waveguide;

wherein the permittivity of a substrate having the resistance-film patterns formed thereon is higher than the permittivity of the dielectric strip.

10. A dielectric-waveguide attenuator comprising:

two substantially parallel planar conductors;

a dielectric strip disposed therebetween so that a dielectric waveguide is formed;

a reflected-wave suppressing structure for changing line impedance of the dielectric waveguide at a plurality of discontinuous parts and suppressing the reflected waves occurring at the plurality of discontinuous parts; and resistance films forming at least a part of the reflected-wave suppressing structure, the resistance films being disposed on a surface defined within the dielectric strip and substantially in parallel to the planar conductors to attenuate signals propagating through the dielectric waveguide;

wherein a distance defined between the plurality of discontinuous parts is an odd multiple of substantially one-fourth the wavelength of a reflected wave to be suppressed.

11. A dielectric-waveguide attenuator according to claim 10, wherein the plurality of discontinuous parts comprises at least three discontinuous parts, and at least two wavelengths of reflected waves due to reflections occurring respectively at said at least three discontinuous parts are suppressed.

12. A dielectric-waveguide attenuator according to claim 10 wherein the resistance films have different widths in a direction perpendicular to the dielectric strip, the parts having said different widths defining said plurality of discontinuous parts.

13. A dielectric-waveguide attenuator according to claim 12, wherein the plurality of discontinuous parts comprises at least three discontinuous parts, and at least two wavelengths of reflected waves due to reflections occurring respectively at said at least three discontinuous parts are suppressed.

14. A dielectric-waveguide attenuator according to claim 10, wherein the resistance films are intermittently disposed in a direction in which the dielectric strip extends, and the intermittent resistance films define the plurality of discontinuous parts.

15. A dielectric-waveguide attenuator according to claim 14, wherein the plurality of discontinuous parts comprises at least three discontinuous parts, and at least two wavelengths of reflected waves due to reflections occurring respectively at said at least three discontinuous parts are suppressed.

* * * * *